US011094261B2

(12) United States Patent
Ding et al.

(10) Patent No.: US 11,094,261 B2
(45) Date of Patent: Aug. 17, 2021

(54) PIXEL CIRCUIT, COMPENSATION ASSEMBLY, DISPLAY APPARATUS AND DRIVING METHOD THEREOF

(71) Applicant: BOE TECHNOLOGY GROUP CO., LTD., Beijing (CN)

(72) Inventors: Xiaoliang Ding, Beijing (CN); Xue Dong, Beijing (CN); Haisheng Wang, Beijing (CN); Yingming Liu, Beijing (CN); Wei Liu, Beijing (CN); Changfeng Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 30 days.

(21) Appl. No.: 16/613,293

(22) PCT Filed: Mar. 6, 2019

(86) PCT No.: PCT/CN2019/077192
§ 371 (c)(1),
(2) Date: Nov. 13, 2019

(87) PCT Pub. No.: WO2019/218756
PCT Pub. Date: Nov. 21, 2019

(65) Prior Publication Data

US 2021/0134222 A1 May 6, 2021

(30) Foreign Application Priority Data

May 14, 2018 (CN) ..... 201810457879.0

(51) Int. Cl.
*G09G 3/3258* (2016.01)

(52) U.S. Cl.
CPC ..... *G09G 3/3258* (2013.01); *G09G 2360/141* (2013.01)

(58) Field of Classification Search
CPC ..... G09G 3/3258; G09G 2360/141
See application file for complete search history.

(56) References Cited

U.S. PATENT DOCUMENTS

2005/0007320 A1 1/2005 Smith et al.
2006/0012311 A1* 1/2006 Ogawa ..... G09G 3/3233 315/169.3

(Continued)

FOREIGN PATENT DOCUMENTS

CN 1582463 A 2/2005
CN 1685390 A 10/2005

(Continued)

OTHER PUBLICATIONS

International Search Report and Written Opinion issued in corresponding International Application No. PCT/CN2019/077192, dated Jun. 11, 2019, with English translation.

(Continued)

*Primary Examiner* — Roberto W Flores
(74) *Attorney, Agent, or Firm* — McDermott Will and Emery LLP

(57) ABSTRACT

A pixel circuit includes a driving sub-circuit and a photosensitive detection circuit. The driving sub-circuit is coupled to a self-luminescent device. The driving sub-circuit is configured to drive the self-luminescent device to emit light. The photosensitive detection circuit is configured to detect a luminance of the self-luminescent device, and transmit an electrical signal for characterizing the luminance of the self-luminescent device to a signal readout terminal.

16 Claims, 7 Drawing Sheets

(56) References Cited

U.S. PATENT DOCUMENTS

| | | | | |
|---|---|---|---|---|
| 2006/0038751 | A1 | 2/2006 | Johnson et al. | |
| 2008/0284891 | A1* | 11/2008 | Hattori | H04N 5/3598 348/308 |
| 2009/0243498 | A1 | 10/2009 | Childs et al. | |
| 2010/0149079 | A1* | 6/2010 | Yamashita | G09G 3/3233 345/87 |
| 2011/0164011 | A1* | 7/2011 | Yamamoto | G09G 3/3233 345/207 |
| 2011/0221720 | A1 | 9/2011 | Kuo et al. | |
| 2013/0043796 | A1* | 2/2013 | Ko | G09G 3/3233 315/151 |
| 2014/0198085 | A1* | 7/2014 | Park | G09G 3/3233 345/207 |
| 2015/0220201 | A1* | 8/2015 | Wu | G06F 3/04166 345/173 |
| 2015/0302793 | A1* | 10/2015 | In | G09G 3/3208 345/211 |
| 2016/0041676 | A1* | 2/2016 | Tan | G06F 3/042 345/173 |
| 2019/0164493 | A1 | 5/2019 | Liu et al. | |
| 2019/0355302 | A1 | 11/2019 | Ding et al. | |

FOREIGN PATENT DOCUMENTS

| | | | |
|---|---|---|---|
| CN | 1833268 | A | 9/2006 |
| CN | 101197107 | A | 6/2008 |
| CN | 101283392 | A | 10/2008 |
| CN | 101976679 | A | 2/2011 |
| CN | 102122485 | A | 7/2011 |
| CN | 103280181 | A | 9/2013 |
| CN | 106782272 | A | 5/2017 |
| CN | 106981268 | A | 7/2017 |
| CN | 107863065 | A | 3/2018 |
| CN | 107908310 | A | 4/2018 |
| CN | 108538255 | A | 9/2018 |
| KR | 10-2016-0069986 | A | 6/2016 |
| WO | 2006123293 | A2 | 11/2006 |
| WO | 2007042973 | A1 | 4/2007 |
| WO | 2019091105 | A1 | 5/2019 |

OTHER PUBLICATIONS

First Office Action issued in corresponding Chinese Application No. 201810457879.0, dated Apr. 29, 2020, with English language translation.

* cited by examiner

PIXEL CIRCUIT, COMPENSATION ASSEMBLY, DISPLAY APPARATUS AND DRIVING METHOD THEREOF

CROSS-REFERENCE TO RELATED APPLICATION

This application is a national phase entry under 35 USC 371 of International Patent Application No. PCT/CN2019/077192 filed on Mar. 6, 2019, which claims priority to Chinese Patent Application No. 201810457879.0, filed with the Chinese Patent Office on May 14, 2018, titled "PIXEL CIRCUIT, COMPENSATION ASSEMBLY, DISPLAY APPARATUS AND DRIVING METHOD THEREOFOF", which are incorporated herein by reference in their entirety.

TECHNICAL FIELD

The present disclosure relates to the field of display technologies, and in particular, to a pixel circuit, a compensation assembly, a display apparatus and a driving method thereof.

BACKGROUND

An organic light-emitting diode (OLED) display apparatus has become one of the most promising display apparatuses due to its advantages of self-luminescence, high luminescence efficiency, short response time, high definition and high contrast. The OLED display apparatuses are mainly classified into two types: active matrix OLED (AMOLED) display apparatuses and passive matrix OLED (PMOLED) display apparatuses. The AMOLED is increasingly recognized by people and gradually becomes a mainstream development trend of the OLED display apparatuses due to its advantages such as low manufacturing cost and large operating temperature range, and advantages that the AMOLED may be used for a direct current (DC) drive of a portable device, and may be used for a large-size display apparatus having a high definition.

SUMMARY

In an aspect, a pixel circuit is provided. The pixel circuit includes a driving sub-circuit and a photosensitive detection circuit. The driving sub-circuit is coupled to a self-luminescent device. The driving sub-circuit is configured to drive the self-luminescent device to emit light. The photosensitive detection circuit is configured to detect a luminance of the self-luminescent device, and transmit an electrical signal for characterizing the luminance of the self-luminescent device to a signal readout terminal.

In some embodiments of the present disclosure, the photosensitive detection circuit is coupled to the driving sub-circuit. The photosensitive detection circuit is further configured to transmit a supply voltage to the driving sub-circuit.

In some embodiments of the present disclosure, the photosensitive detection circuit includes a photosensitive device. The photosensitive device is configured to detect the luminance of the self-luminescent device, and transmit the electrical signal for characterizing the luminance of the self-luminescent device to the signal readout terminal.

In some embodiments of the present disclosure, the photosensitive detection circuit includes a photosensitive device and a readout circuit. The photosensitive device is configured to detect the luminance of the self-luminescent device.

The readout circuit is coupled to the photosensitive device and the signal readout terminal, and the readout circuit is configured to transmit the electrical signal for characterizing the luminance of the self-luminescent device to the signal readout terminal.

In some embodiments of the present disclosure, the photosensitive device includes a photosensitive diode, a first transistor and a second transistor. A first electrode of the photosensitive diode is coupled to a first voltage terminal, and a second electrode of the photosensitive diode is coupled to a first electrode of the first transistor. A control electrode of the first transistor is coupled to a first control signal terminal, and a second electrode of the first transistor is coupled to an output terminal. A control electrode of the second transistor is coupled to a second control signal terminal, a first electrode of the second transistor is coupled to a second voltage terminal, and a second electrode of the second transistor is coupled to the output terminal. The photosensitive diode is located in a position where the photosensitive diode is capable of detecting the light emitted from the self-luminescent device.

In some embodiments of the present disclosure, the readout circuit includes a third transistor and a fourth transistor. A control electrode of the third transistor is coupled to an output terminal of the photosensitive device, a first electrode of the third transistor is coupled to the second voltage terminal, and a second electrode of the third transistor is coupled to a first electrode of the fourth transistor and the driving sub-circuit. A control electrode of the fourth transistor is coupled to a third control signal terminal, and a second electrode of the fourth transistor is coupled to the signal readout terminal.

In some embodiments of the present disclosure, the driving sub-circuit includes a driving transistor. A control electrode of the driving transistor is coupled to a data voltage terminal, a first electrode of the driving transistor is coupled to the second electrode of the third transistor, and a second electrode of the driving transistor is coupled to the self-luminescent device.

In some embodiments of the present disclosure, the driving sub-circuit further includes a fifth transistor, a sixth transistor and a storage capacitor. The control electrode of the driving transistor is coupled to the data voltage terminal through the fifth transistor. A first electrode of the fifth transistor is coupled to the data voltage terminal, a second electrode of the fifth transistor is coupled to the control electrode of the driving transistor, and a control electrode of the fifth transistor is coupled to a scanning signal terminal. A first electrode of the storage capacitor is coupled to the control electrode of the driving transistor and the second electrode of the fifth transistor, and a second electrode of the storage capacitor is coupled to the second electrode of the driving transistor and the self-luminescent device. A control electrode of the sixth transistor is coupled to the scanning signal terminal, a first electrode of the sixth transistor is coupled to the second electrode of the driving transistor, and a second electrode of the sixth transistor is coupled to the signal readout terminal.

In some embodiments of the present disclosure, the photosensitive detection circuit includes a photosensitive device. The photosensitive device includes a photosensitive diode, a first transistor, and a second transistor. A first electrode of the photosensitive diode is coupled to a first voltage terminal, and a second electrode of the photosensitive diode is coupled to a first electrode of the first transistor. A control electrode of the first transistor is coupled to a first control signal terminal, and a second electrode of the first transistor is coupled to an output terminal. A control electrode of the second transistor is coupled to a second control signal terminal, a first electrode of the second transistor is coupled to a supply voltage terminal, and a second electrode of the second transistor is coupled to the output terminal. The photosensitive diode is located in a position where the photosensitive diode is capable of detecting the light emitted from the self-luminescent device.

The photosensitive detection circuit further includes a readout circuit. The readout circuit includes a third transistor, a fourth transistor and a current source. A control electrode of the third transistor is coupled to an output terminal of the photosensitive device, a first electrode of the third transistor is coupled to the supply voltage terminal, and a second electrode of the third transistor is coupled to a first electrode of the fourth transistor and the current source. A control electrode of the fourth transistor is coupled to a third control signal terminal, and a second electrode of the fourth transistor is coupled to the signal readout terminal.

The driving sub-circuit includes a fifth transistor, a sixth transistor, a driving transistor, and a storage capacitor. A control electrode of the fifth transistor is coupled to a scanning signal terminal, a first electrode of the fifth transistor is coupled to a data voltage terminal, and a second electrode of the fifth transistor is coupled to a control electrode of the driving transistor. A first electrode of the driving transistor is coupled to the output terminal of the photosensitive device, and a second electrode of the driving transistor is coupled to the self-luminescent device. A control electrode of the sixth transistor is coupled to the scanning signal terminal, a first electrode of the sixth transistor is coupled to the second electrode of the driving transistor, and a second electrode of the sixth transistor is coupled to the signal readout terminal. A first electrode of the storage capacitor is coupled to the control electrode of the driving transistor and the second electrode of the fifth transistor, and a second electrode of the storage capacitor is coupled to the second electrode of the driving transistor and the first electrode of the self-luminescent device. In some embodiments, the pixel circuit further includes the self-luminescent device.

In another aspect, a compensation assembly is provided. The compensation assembly includes at least one pixel circuit described above, a source driving circuit, and a controller coupled to both the at least one pixel circuit and the source driving circuit. The controller is configured to obtain an actual luminance of at least one self-luminescent device according to at least one electrical signal output by the at least one pixel circuit for characterizing luminance of the at least one self-luminescent device, and compensate a data voltage signal according to a difference between an actual luminance and a target luminance of each self-luminescent device. The source driving circuit is configured to output a driving signal to a corresponding one of the at least one pixel circuit based on the compensated data voltage signal.

In yet another aspect, a display apparatus is provided. The display apparatus includes the compensation assembly described above.

In yet another aspect, a compensation method of the compensation assembly described above is provided. The compensation method includes; detecting an actual luminance of each self-luminescent device; comparing the actual luminance and a target luminance, and compensating a data voltage signal according to a difference between the actual luminance and the target luminance; and outputting a driving signal according to the compensated data voltage signal.

In yet another aspect, a method of driving the display apparatus described above is provided. Time of a frame includes a luminescence and detection period and a readout period. The driving method includes: driving each self-luminescent device to emit light and detecting a luminance of the self-luminescent device in the luminescence and detection period; and transmitting an electrical signal for characterizing the luminance of the self-luminescent device to a signal readout terminal in the readout period.

In some embodiments of the present disclosure, a photosensitive detection circuit of a pixel circuit in the display apparatus includes a photosensitive diode, a first transistor, a second transistor, a third transistor, and a fourth transistor; and a driving sub-circuit includes a fifth transistors, a sixth transistor, a driving transistor, and a storage capacitor.

Driving the self-luminescent device to emit light, includes:

controlling the second transistor to be turned on, transmitting, by the second transistor, a supply voltage signal from a second voltage terminal to a control electrode of the third transistor, and controlling the third transistor to be turned on;

transmitting, by the third transistor, the supply voltage signal from the second voltage terminal to a first electrode of the driving transistor;

controlling the fifth transistor and the sixth transistor to be turned on, transmitting, by the fifth transistor, a data voltage signal from a data voltage terminal to a control electrode of the driving transistor and a first electrode of the storage capacitor, and transmitting, by the sixth transistor, a potential signal of the signal readout terminal to a second electrode of the driving transistor; and controlling, by the data voltage signal, the driving transistor to be turned on, and outputting, by the driving transistor, a driving signal via the second electrode of the driving transistor to the self-luminescent device to drive the self-luminescent device to emit light.

In some embodiments of the present disclosure, detecting the luminance of the self-luminescent device, includes:

controlling the first transistor to be turned on before controlling the second transistor to be turned on;

after controlling the second transistor to be turned on, transmitting the supply voltage signal from the second voltage terminal to a second electrode of the photosensitive diode, so that the photosensitive diode is reverse biased;

controlling the first transistor to be turned off, a voltage on the second electrode of the photosensitive diode being changed under illumination of the self-luminescent device; and detecting the luminance of the self-luminescent device according to a change of the voltage on the second electrode of the photosensitive diode.

In some embodiments of the present disclosure, transmitting the electrical signal for characterizing the luminance of the self-luminescent device to the signal readout terminal, includes:

controlling the first transistor to be turned on, and transmitting the voltage on the second electrode of the photosensitive diode to the control electrode of the third transistor; and controlling the fourth transistor to be turned on, transmitting a voltage on a second electrode of the third transistor to the signal readout terminal, and the voltage on the second electrode of the third transistor following a voltage on the control electrode of the third transistor in phase.

BRIEF DESCRIPTION OF THE DRAWINGS

In order to describe technical solutions in some embodiments of the present disclosure more clearly, the accompanying drawings to be used in embodiments will be introduced briefly. Obviously, the accompanying drawings to be described below are merely some embodiments of the present disclosure, and a person of ordinary skill in the art can obtain other drawings according to these drawings without paying any creative effort.

DETAILED DESCRIPTION

The technical solutions in some embodiments of the present disclosure will be described with reference to the accompanying drawings in some embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

Figure 1:
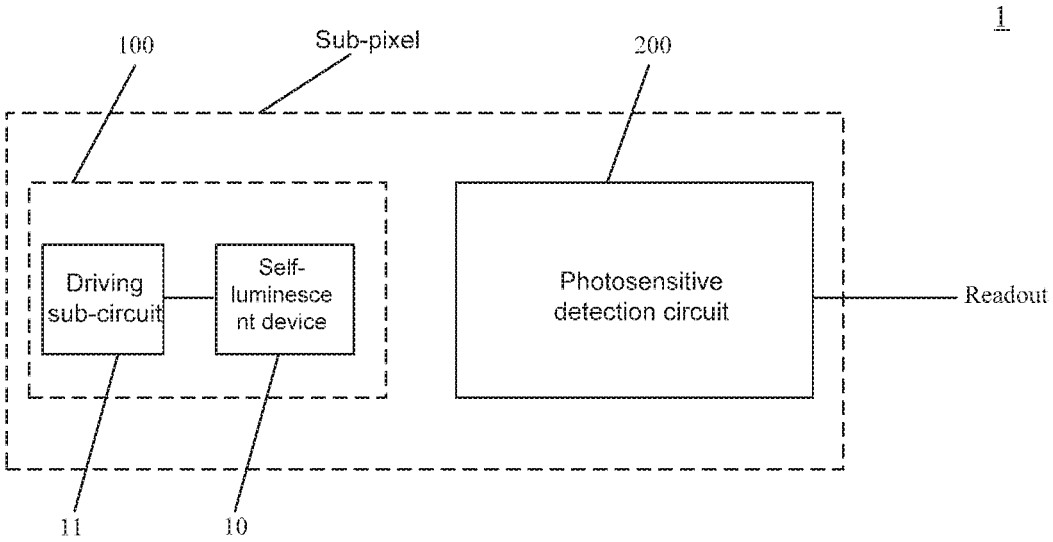
FIG. 1 is a schematic diagram showing a structure of a pixel circuit, according to some embodiments of the present disclosure.

Some embodiments of the present disclosure provide a pixel circuit. Referring to FIG. 1, the pixel circuit 1 includes a pixel driving circuit 100 and a photosensitive detection circuit 200. The pixel driving circuit 100 includes a self-luminescent device 10 and a driving sub-circuit 11 coupled to the self-luminescent device 10. The driving sub-circuit 11 is configured to drive the self-luminescent device 10 to emit light. The photosensitive detection circuit 200 is configured to detect a luminance of the self-luminescent device 10, and transmit an electrical signal for characterizing the luminance of the self-luminescent device 10 to a signal readout terminal Readout.

It will be noted that, firstly, a person of ordinary skill in the art will understand that the driving sub-circuit 11 is configured to enable a corresponding sub-pixel in a display apparatus to emit light, and an essence thereof is that the driving sub-circuit 11 is used to drive the self-luminescent device 10 (an electroluminescent device, such as an organic light-emitting diode (OLED)) to emit light. Some embodiments of the present disclosure do not specifically limit a structure of the driving sub-circuit 11, as long as the driving sub-circuit 11 is capable of driving the self-luminescent device 10 to emit light.

Secondly, after the photosensitive detection circuit 200 detects the luminance of the self-luminescent device 10, it generates the electrical signal for characterizing the luminance of the self-luminescent device 10, and the electrical signal may be an electrical signal that directly reflects the luminance, or an electrical signal that indirectly reflects the luminance. However, it may be determined that a single electrical signal value corresponds to a single luminance value. An actual luminance of the self-luminescent device 10 may be accurately obtained by using the photosensitive detection circuit 200.

Thirdly, the photosensitive detection circuit 200 is configured to detect the luminance of the self-luminescent device 10, and the photosensitive detection circuit 200 is necessarily disposed at a position where the photosensitive detection circuit 200 may detect light exiting from the self-luminescent device 10.

Fourthly, the above pixel circuit 1 may be included in a display panel of the display apparatus. The display panel includes a plurality of sub-pixels. In some embodiments of the present disclosure, at least one sub-pixel is provided with the above pixel circuit 1 therein. The pixel circuit 1 may be used to effectively compensate a luminance of a self-luminescent device 10 in a corresponding sub-pixel. Of course, if each sub-pixel in the display panel is provided with the pixel circuit 1 described above, the luminance of each self-luminescent device 10 in the display panel may be effectively compensated by using a corresponding pixel circuit 1, thereby ensuring that the display panel has a better luminance compensation effect. In addition, the pixel circuits 1 in the display panel may simultaneously compensate the luminance of respective self-luminescent devices 10, or may compensate the luminance of respective self-luminescent devices 10 in portions and in different periods of time.

It will be understood that, as for the display apparatus (especially an active matrix OLED (AMOLED) display apparatus), in the sub-pixels of the display panel, threshold voltages of driving transistors configured to drive the self-luminescent devices 10 to emit light are easy to drift due to a process, a material, a design, and the like, thereby causing an uneven luminance of an image displayed by the display panel. Moreover, a problem of an IR drop in the display panel, that is, a problem that a supply voltage transmitted to each sub-pixel of the display panel is easily lowered gradually due to an increase of a distance from the sub-pixel to a power supply position, and a problem of aging of other devices including the self-luminescent device 10 in the display panel, etc., may also cause the uneven luminance of the image displayed by the display panel.

In some embodiments of the present disclosure, the sub-pixel is provided with the above pixel circuit 1 therein, and the photosensitive detection circuit 200 in the pixel circuit 1 may be used to accurately detect an actual luminance of a self-luminescent device 10 in the same sub-pixel. In a case where the uneven luminance of the self-luminescent devices 10 in the pixel circuits 1 is caused by various reasons, in some embodiments of the present disclosure, the photosensitive detection circuit 200 is used to detect the actual luminance of the self-luminescent device 10 in the corresponding sub-pixel, and a current luminescent capability of each self-luminescent device 10 may be accurately determined according to the actual luminance of each self-luminescent device 10, thereby compensating the luminance of the self-luminescent device 10 of each sub-pixel. The luminance compensation herein is a compensation that is determined after combining various factors causing the uneven luminance. Therefore, the uneven luminance due to the aging of the self-luminescent device 10 and the IR drop may be effectively improved to improve the luminance compensation effect of the display panel.

Figure 2:
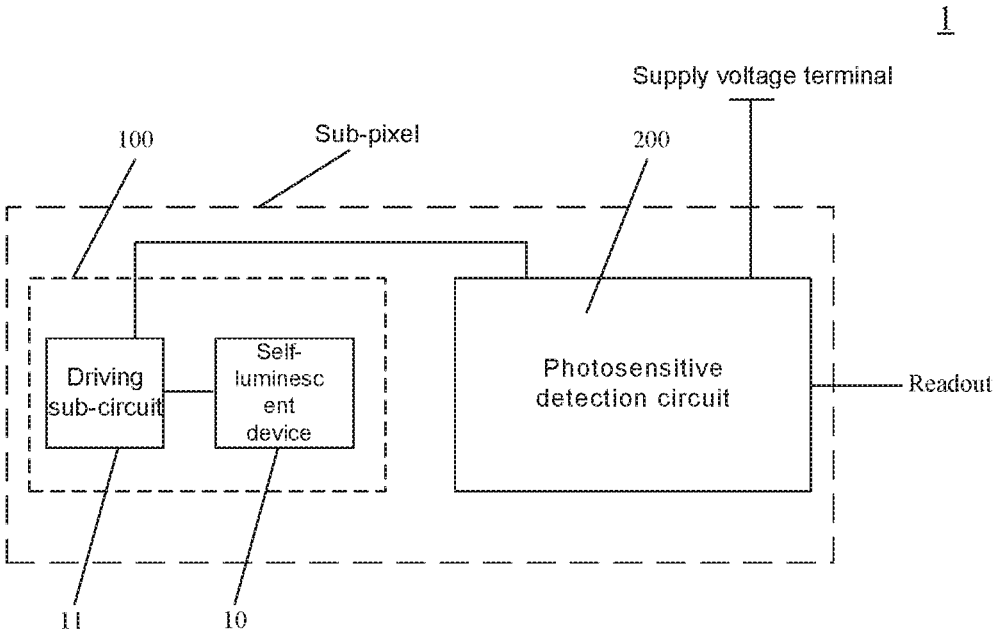
FIG. 2 is a schematic diagram showing a structure of another pixel circuit, according to some embodiments of the present disclosure.

In some embodiments of the present disclosure, referring to FIG. 2, the photosensitive detection circuit 200 is coupled to the driving sub-circuit 11. The photosensitive detection circuit 200 is further configured to input a supply voltage to the driving sub-circuit 11 in a luminescence and detection period, and stop inputting the supply voltage to the driving sub-circuit 11 in a readout period.

It will be noted that the photosensitive detection circuit 200 described above is configured to control whether to input the supply voltage to the driving sub-circuit 11, and the photosensitive detection circuit 200 is necessarily coupled to a supply voltage terminal. The photosensitive detection circuit 200 is equivalent to a switch for controlling whether the supply voltage terminal is in communication with the driving sub-circuit 11 while detecting the luminance of the self-luminescent device 10 in the corresponding sub-pixel. Thus, in the luminescence and detection period, the photosensitive detection circuit 200 receives the supply voltage from the supply voltage terminal, and the photosensitive detection circuit 200 may also transmit the supply voltage to the driving sub-circuit 11 of the pixel driving circuit 100. That is to say, a luminescence driving of the pixel driving circuit 100 and a luminance detection of the photosensitive detection circuit 200 may be performed by using the supply voltage supplied from a same supply voltage terminal. That is, the pixel driving circuit 100 and the photosensitive detection circuit 200 may share the same supply voltage terminal, thereby reducing wires in the display panel, reducing the number of voltage terminals, and improving an integration degree of the pixel circuit 1.

Figure 3:
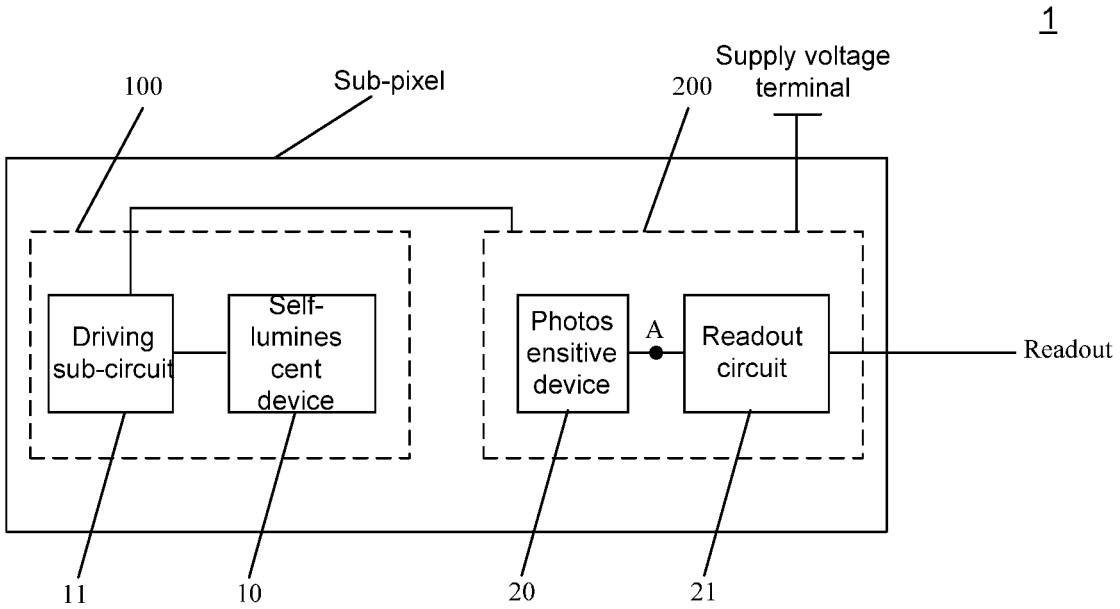
FIG. 3 is a schematic diagram showing a structure of yet another pixel circuit, according to some embodiments of the present disclosure.

In some embodiments of the present disclosure, referring to FIG. 3, the photosensitive detection circuit 200 is configured to detect the luminance of the self-luminescent device 10 in the corresponding sub-pixel, and the photosensitive detection circuit 200 includes a photosensitive device 20. The photosensitive device 20 is configured to detect the luminance of the self-luminescent device 10, and transmit an electrical signal for characterizing the luminance of the self-luminescent device 10 to the signal readout terminal Readout. The photosensitive device 20 is disposed at a position where the photosensitive device 20 may be irradiated by light emitted from the self-luminescent device 10. Of course, in some embodiments of the present disclosure, referring to FIG. 3, the photosensitive detection circuit 200 further includes a readout circuit 21. The readout circuit 21 is coupled to an output terminal A of the photosensitive device 20 and the signal readout terminal Readout. The readout circuit 21 is configured to transmit the electrical signal for characterizing the luminance of the self-luminescent device 10 from the output terminal A of the photosensitive device 20 described above to the signal readout terminal Readout. The readout circuit 21 is configured to read signals, and a structure of the readout circuit 21 is designed to enable an aperture ratio of the corresponding sub-pixel to be maximized.

Figure 4:
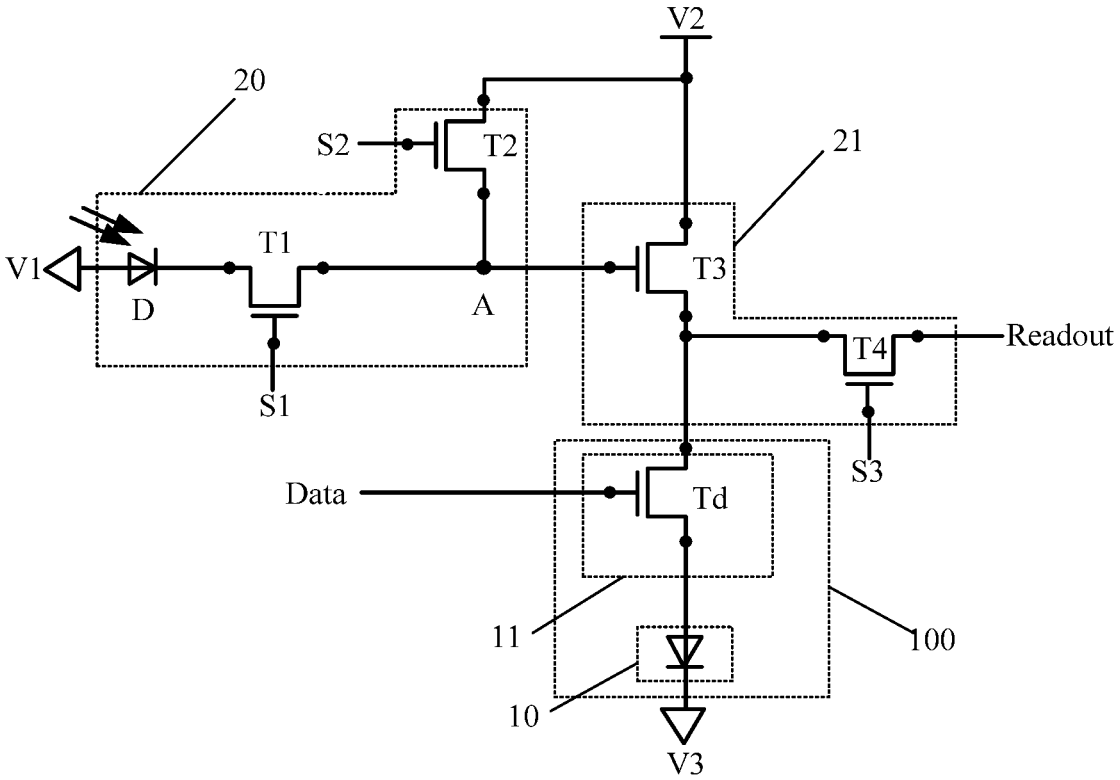
FIG. 4 is a schematic diagram showing an internal structure of the pixel circuit shown in FIG. 3.

In some embodiments of the present disclosure, referring to FIG. 4, the photosensitive device 20 includes a photosensitive diode D, a first transistor T1, and a second transistor T2. A first electrode of the photosensitive diode D is coupled to a first voltage terminal V1, and a second electrode of the photosensitive diode D is coupled to a first electrode of the first transistor T1. A control electrode of the first transistor T1 is coupled to a first control signal terminal S1, and a second electrode of the first transistor T1 is coupled to the output terminal A. A control electrode of the second transistor T2 is coupled to a second control signal terminal S2, a first electrode of the second transistor T2 is coupled to a second voltage terminal V2, and a second electrode of the second transistor T2 is coupled to the output terminal A.

A photosensitive region of the photosensitive diode D is located in a light irradiation region of the self-luminescent device 10 in the corresponding sub-pixel when the self-luminescent device emits light. That is, the photosensitive diode D should be disposed at a position where the photosensitive diode D may be ensured to be irradiated by the light emitted from the self-luminescent device 10 to be detected. It will be understood that, if a single photosensitive diode D is only used to detect the luminance of a single self-luminescent device 10, the photosensitive diode D should be disposed at a position where the photosensitive diode D is ensured not to be irradiated by light emitted from other self-luminescent devices 10 other than the self-luminescent device 10 to be detected. If a single photosensitive diode D is used to detect the luminance of a plurality of self-luminescent devices 10, the photosensitive diode D should be disposed at a position where the photosensitive diode D may be ensured to be irradiated by the light emitted from each self-luminescent devices 10 to be detected. In this case, the self-luminescent devices 10 corresponding to the single photosensitive diode D should emit light at different periods of time respectively, so that the photosensitive diode D may detect the corresponding plurality of self-luminescent devices 10 in different periods of time.

Optionally, the photosensitive region of the photosensitive diode D is directly opposite to the light irradiation region of the self-luminescent device 10. That is, the photosensitive region of the photosensitive diode D is located in a region irradiated by the direct light exiting from the self-luminescent device 10, which may facilitate the photosensitive diode D to obtain more light, thereby further improving a detection effect of the photosensitive detection circuit 200.

In some embodiments of the present disclosure, with continued reference to FIG. 4, the readout circuit 21 includes a third transistor T3 and a fourth transistor T4. A control electrode of the third transistor T3 is coupled to the output terminal A of the photosensitive device 20, a first electrode of the third transistor T3 is coupled to the second voltage terminal V2, and a second electrode of the third transistor T3 is coupled to a first electrode of the fourth transistor T4 and the driving sub-circuit 11 in the pixel driving circuit 100. A control electrode of the fourth transistor T4 is coupled to a third control signal terminal S3, and a second electrode of the fourth transistor T4 is coupled to the signal readout terminal Readout.

With continued reference to FIG. 4, the driving sub-circuit 11 includes a driving transistor Td. A control electrode of the driving transistor Td is coupled to a data voltage terminal Data, a first electrode of the driving transistor Td is coupled to the second electrode of the third transistor T3, and a second electrode of the driving transistor Td is coupled to the self-luminescent device 10. A supply voltage required to be received by the driving transistor Td during operation is provided by the second voltage terminal V2. In the luminescence and detection period, the supply voltage provided by the second voltage terminal V2 may be transmitted to the first electrode of the driving transistor Td through the second transistor T2 in the photosensitive device 20 and the third transistor T3 in the readout circuit 21, so that the driving sub-circuit 11 drives the self-luminescent device 10 to emit light.

Figure 5:
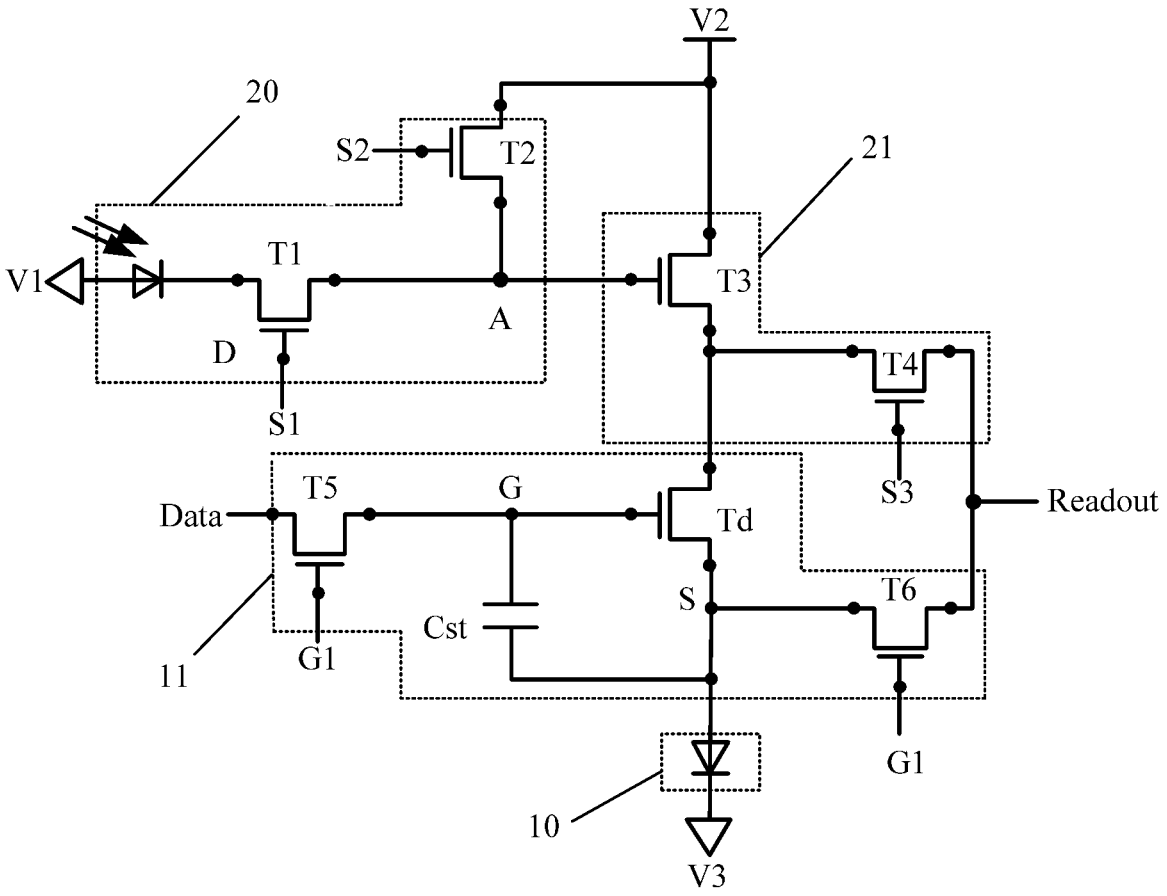
FIG. 5 is a schematic diagram showing another internal structure of the pixel circuit shown in FIG. 3.

Of course, the structure of the driving sub-circuit 11 in the pixel driving circuit 100 is not limited thereto. Referring to FIG. 5, in some embodiments of the present disclosure, the driving sub-circuit 11 includes a fifth transistor T5, a sixth transistor T6, the driving transistor Td, and a storage capacitor Cst. A control electrode of the fifth transistor T5 is coupled to a scanning signal terminal G1, a first electrode of the fifth transistor T5 is coupled to the data voltage terminal Data, and a second electrode of the fifth transistor T5 is coupled to the control electrode of the driving transistor Td. The first electrode of the driving transistor Td is coupled to the photosensitive detection circuit 200, and the second electrode of the driving transistor Td is coupled to a first electrode of the self-luminescent device 10. A second electrode of the self-luminescent device 10 is coupled to a third voltage terminal V3. A control electrode of the sixth transistor T6 is coupled to the scanning signal terminal G1, a first electrode of the sixth transistor T6 is coupled to the second electrode of the driving transistor Td, and a second electrode of the sixth transistor T6 is coupled to the signal readout terminal Readout. A first electrode of the storage capacitor Cst is coupled to the control electrode of the driving transistor Td and the second electrode of the fifth transistor T5, and a second electrode of the storage capacitor Cst is coupled to the second electrode of the driving transistor Td.

Figure 6:
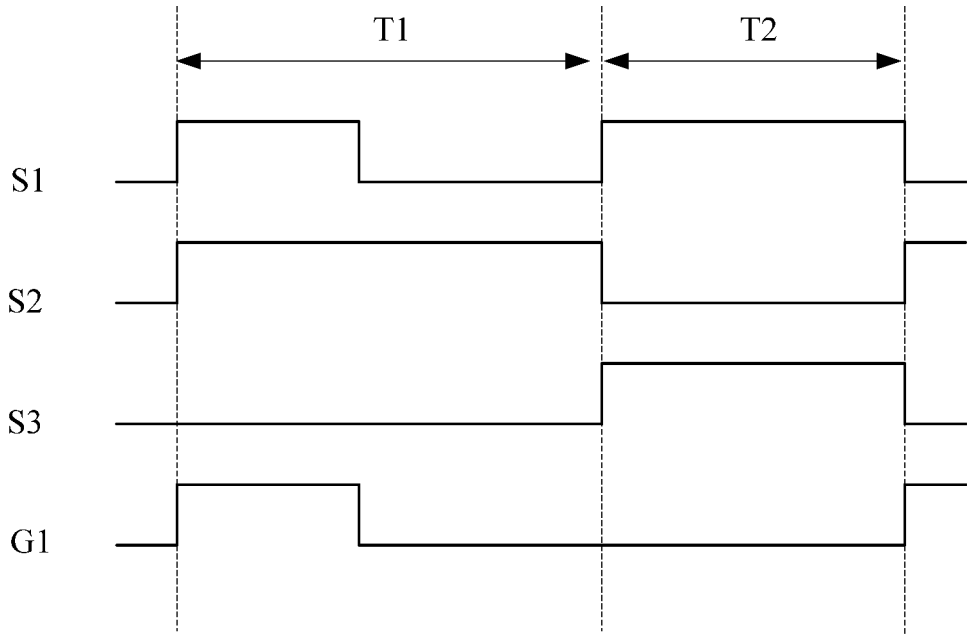
FIG. 6 is a timing diagram of controlling the pixel circuit shown in FIG. 5.

In some embodiments of the present disclosure, in a case where the driving sub-circuit 11 has the structure shown in FIG. 5, a timing diagram of a driving process of a corresponding pixel circuit 1 is as shown in FIG. 6. Time of a frame includes a luminescence and detection period T1 and a readout period T2.

In the luminescence and detection period T1, a turn-on signal is input via the scanning signal terminal G1 to control the fifth transistor T5 and the sixth transistor T6 to be turned on. A data voltage signal from the data voltage terminal Data is transmitted to a point G via the fifth transistor T5, a voltage signal of the signal readout terminal Readout is transmitted to a point S via the sixth transistor T6, and the storage capacitor Cst stores a voltage difference Vgs between the point G and the point S. A turn-on signal is input via the second control signal terminal S2 to control the second transistor T2 to be turned on, and the second transistor transmits a voltage signal from the second voltage terminal V2 to the output terminal A. Then, the third transistor T3 is controlled to be turned on. In this case, since the fourth transistor T4 is in a turn-off state, the signal readout terminal Readout cannot read a signal, the voltage signal from the second voltage terminal V2 is transmitted to the first electrode of the driving transistor Td via the third transistor T3, and the self-luminescent device 10 emits light under driving of a driving current output from the second electrode of the driving transistor Td.

While the turn-on signal is input via the second control signal terminal S2, a turn-on signal is input via the first control signal terminal S1 to control the first transistor T1 to be turned on, and the voltage signal from the second voltage terminal V2 is transmitted to the second electrode of the photosensitive diode D via the second transistor T2 and the first transistor T1, so that the photosensitive diode D is reverse biased. After the photosensitive diode D is reverse biased, a turn-off signal is input via the first control signal terminal S1 to control the first transistor T1 to be turned off. In an entire luminescence and detection period T1, the second transistor T2 is always in a turn-on state, and the self-luminescent device 10 is in a luminescent state. The photosensitive diode D generates a photocurrent under an action of illumination of the self-luminescent device 10, which reduces a potential on the second electrode of the photosensitive diode D.

In the readout period T2, a turn-off signal is input via the second control signal terminal S2 to control the second transistor T2 to be turned off, and the self-luminescent device 10 stops emitting light. The turn-on signal is input via the first control signal terminal S1 to control the first transistor T1 to be turned on. A turn-on signal is input via the third control signal terminal S3 to control the fourth transistor T4 to be turned on. The potential on the second electrode of the photosensitive diode D is transmitted to the output terminal A via the first transistor T1. The potential on the second electrode of the photosensitive diode D refers to a quantity of charges stored in the photosensitive diode D, and the charges are charges accumulated on the second electrode of the photosensitive diode D due to a photoelectric integration during a luminescence process of a frame.

In this period, as for the driving transistor Td, in a case where a difference between a source-to-drain voltage and a threshold voltage is less than a gate-to-source voltage, i.e., $Vds-Vth<Vgs$ (wherein Vds is the source-to-drain voltage of the driving transistor Td, Vth is the threshold voltage of the driving transistor Td, and Vgs is the gate-to-source voltage of the driving transistor Td), the driving transistor Td may be used as a current source. Thus, the driving transistor Td, as the current source of the readout circuit 21, may form a voltage follower circuit with the readout circuit 21, thereby reading a voltage signal from the output terminal A of the photosensitive device 20. For example, by using the driving transistor Td (the current source), a current flowing through the third transistor T3 remains at a constant value, so that a voltage difference between the control electrode and the second electrode of the third transistor T3 is kept constant (that is, a change of a voltage on the control electrode of the third transistor T3 is the same as a change of a voltage on the second electrode of the third transistor T3), thereby ensuring that the voltage on the second electrode of the third transistor T3 follows the voltage on the control electrode of the third transistor T3 in phase, so that the change of the voltage on the control electrode of the third transistor T3 may be reflected in a signal read out by the signal readout terminal Readout. Thus, a signal output from the output terminal A may be known through the signal output by using the signal readout terminal Readout, thereby determining the luminance of the self-luminescent device 10.

When a next frame is displayed, the turn-on signal is input via the scanning signal terminal G1 to control the fifth transistor T5 and the sixth transistor T6 to be turned on, so that the point G and the point S are respectively reset, and the storage capacitor Cst stores the data voltage signal from the data voltage terminal Data (the data voltage signal has been adjusted according to light intensity contrast information fed back by the photosensitive detection circuit 200 in a previous frame). In this case, the gate-to-source voltage Vgs of the driving transistor Td is constant, and the driving transistor Td drives the self-luminescent device 10 to emit light. The turn-on signal from the second control signal terminal S2 controls the second transistor T2 to be turned on, so that the voltage on the control electrode of the third transistor T3 is reset to discharge charges accumulated on the control electrode of the third transistor T3 due to the photoelectric integration in the previous frame.

It will be noted that, firstly, types of respective transistors other than the third transistor T3 are not limited in some embodiments of the present disclosure. For example, the first transistor T1, the second transistor T2, the fourth transistor T4, the fifth transistor T5, the sixth transistor T6, and the driving transistor Td described above are N-type transistors. For another example, the first transistor T1, the second transistor T2, the fourth transistor T4, the fifth transistor T5, the sixth transistor T6, and the driving transistor Td described above are P-type transistors.

Of course, according to different conduction methods inside the transistors, the transistors including the third transistor T3 in the pixel circuit 1 are enhancement-mode transistors or depletion-mode transistors, which is not limited in some embodiments of the present disclosure.

In addition, other than the third transistor T3, the first electrode of each transistor is a drain, and the second electrode of each transistor is a source. Alternatively, the first electrode of each transistor is the source, and the second electrode of each transistor is the drain, which is not limited in some embodiments of the present disclosure.

It will be understood that the voltage signal from the second voltage terminal V2 is required to reverse bias the photosensitive diode D, and the voltage signal from the second voltage terminal V2 is usually a high level signal. The first electrode of the third transistor T3 is coupled to the second voltage terminal V2, and the third transistor T3 is configured to achieve a voltage follower function of the readout circuit 21. That is, the voltage on the second electrode of the third transistor T3 needs to follow the voltage on the control electrode of the third transistor T3 in phase. Therefore, the third transistor T3 is usually an N-type transistor, the first electrode of third transistor T3 is the drain, and the second electrode of third transistor T3 is the source.

Secondly, in some embodiments of the present disclosure, the second voltage terminal V2, as the supply voltage terminal, is configured to provide a high level supply voltage signal VDD. The first voltage terminal V1 and the third voltage terminal V3 are each configured to provide a low level common voltage signal VSS. Of course, it is also permissible that the first voltage terminal V1 and the third voltage terminal V3 are grounded. In addition, optionally, the first voltage terminal V1 and the third voltage terminal V3 are a same voltage terminal. It will be added that the high level and the low level described above are only used to characterize a relative magnitude relationship among the voltage signals, and do not limit values of corresponding voltage signals.

In the pixel circuit 1 provided by some embodiments of the present disclosure, under a premise of ensuring that the luminance of the self-luminescent device 10 may be effectively detected, sharing some components or ports in the photosensitive detection circuit 200 and the pixel driving circuit 100 may greatly improve an integration degree of the pixel circuit 1 to save a manufacturing cost.

Figure 7:
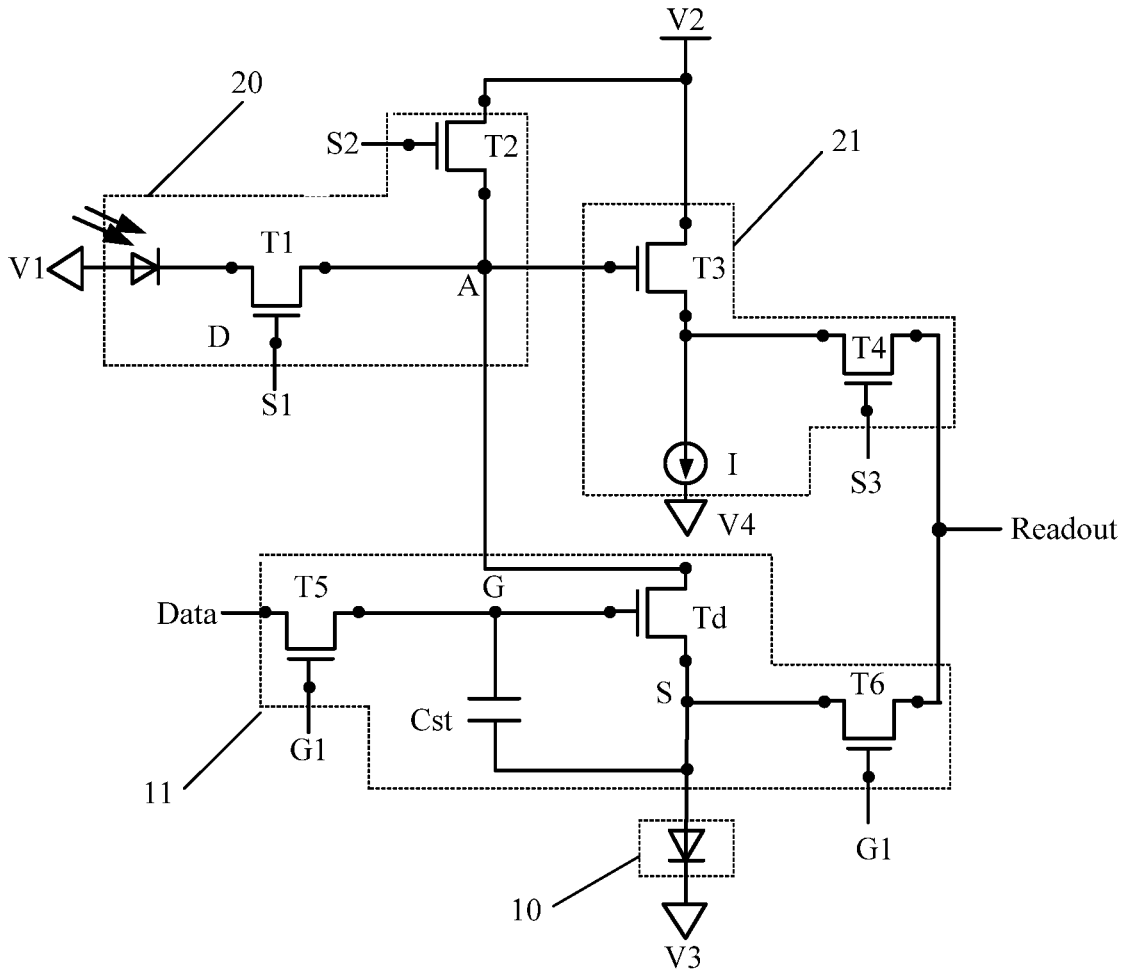
FIG. 7 is a schematic diagram showing yet another internal structure of the pixel circuit shown in FIG. 3.

It is worth mentioning that, in some embodiments of the present disclosure, referring to FIG. 7, the second voltage terminal V2 is the supply voltage terminal, and is configured to provide the supply voltage signal. In this case, the driving sub-circuit 11 is directly coupled to the output terminal A of the photosensitive device 20 in the photosensitive detection circuit 200. For example, the first electrode of the driving transistor Td in the driving sub-circuit 11 is directly coupled to the output terminal A of the photosensitive device 20. Thus, under control of the second control signal terminal S2, the supply voltage from the second voltage terminal V2 (i.e., the supply voltage terminal) may be transmit to the driving sub-circuit 11 in the luminescence and detection period through the second transistor T2 coupled to the output terminal A of the photosensitive device 20, and the supply voltage is stopped transmitting to the driving sub-circuit 11 in the readout period.

Correspondingly, the readout circuit 21 in the photosensitive detection circuit 200 includes the third transistor T3, the fourth transistor T4, and the current source I. The control electrode of the third transistor T3 is coupled to the output terminal A of the photosensitive device 20, the first electrode of the third transistor T3 is coupled to the second voltage terminal V2 (i.e., the supply voltage terminal), and the second electrode of the third transistor T3 is coupled to the first electrode of the fourth transistor T4 and the current source I. The control electrode of the fourth transistor T4 is coupled to the third control signal terminal S3, and the second electrode of the fourth transistor T4 is coupled to the signal readout terminal Readout. Thus, the second electrode of the third transistor T3 in the readout circuit 21 is coupled to a fourth voltage terminal V4 through the independent current source I. The readout circuit 21 may independently achieve the voltage follower function. Of course, the above is only an example of the pixel circuit 1 in some embodiments of the present disclosure, and some embodiments of the present disclosure are not limited to such a structure.

Figure 8:
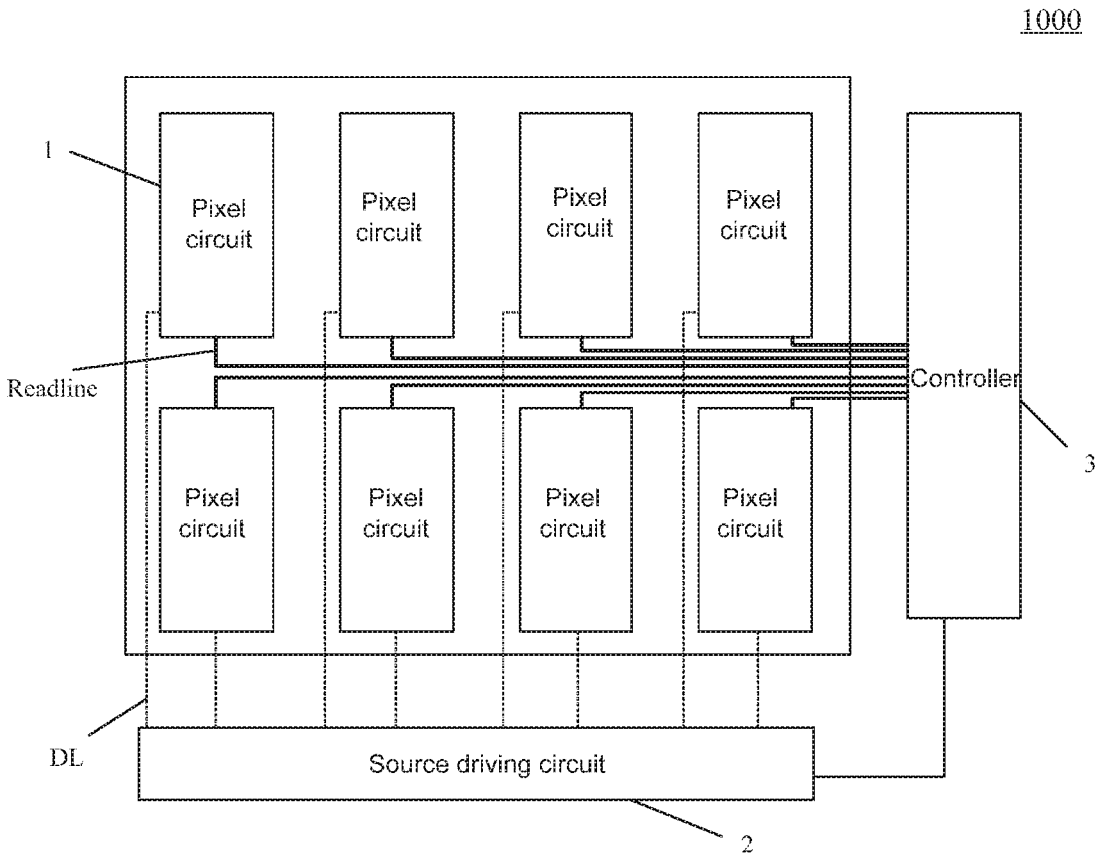
FIG. 8 is a schematic diagram showing a structure of a compensation assembly, according to some embodiments of the present disclosure.

Some embodiments of the present disclosure provide a compensation assembly. Referring to FIG. 8, the compensation assembly 1000 includes at least one pixel circuit 1 according to some embodiments described above. The compensation assembly 1000 further includes a source driving circuit 2, and a controller 3 coupled to both the at least one pixel circuit 1 and the source driving circuit 2.

The controller 3 is configured to obtain the actual luminance of the at least one self-luminescent device 10 according to the at least one electrical signal for characterizing the luminance of the at least one self-luminescent device 10 output by the at least one pixel circuit 1 respectively, and compensate each data voltage signal according to a difference between an actual luminance and a target luminance of a corresponding self-luminescent device 10. The source driving circuit 2 is configured to output a driving signal to the pixel driving circuit 100 of the pixel circuit 1 according to the compensated data voltage signal. As shown in FIG. 8, heavy lines coupling the pixel circuits 1 and the controller 3 are signal read lines Readline, and the signal read line Readline is configured to transmit a signal to the signal readout terminal Readout of the pixel circuit 1. Dotted lines coupling the pixel circuits 1 and the source driving circuit 2 are driving lines DL, and the driving line DL is configured to transmit a signal to the data voltage terminal Data of the pixel circuit 1. The signal read line Readline and the driving line DL are insulated from each other.

It will be added that, if the actual luminance of the self-luminescent device 10 coincides with the target luminance, that is, the difference between the actual luminance and the target luminance is zero or close to zero, there is no need to compensate the data voltage signal, and the source driving circuit 2 only needs to normally output the data voltage signal. If the difference between the actual luminance and the target luminance of the self-luminescent device 10 is large, it is necessary to compensate the data voltage signal of the next frame, and the source driving circuit 2 outputs the driving signal to the pixel driving circuit 100 of the pixel circuit 1 according to the compensated data voltage signal.

The actual luminance described above refers to a luminance of the self-luminescent device 10 detected by the photosensitive detection circuit 200 in the pixel circuit 1. The target luminance refers to a luminance that the self-luminescent device 10 should have under an action of a certain data voltage signal regardless of factors such as the aging of the device and the IR Drop.

In some embodiments of the present disclosure, a plurality of pixel circuits 1 are arranged in an array. The controller 3 may determine a degree to which the data voltage signal of each pixel circuit 1 needs to be compensated when the next frame is displayed according to the difference between the actual luminance and the target luminance of the self-luminescent device 10 in the pixel circuit 1, and compensate the data voltage signal. After the controller 3 transmits the compensated data voltage signals respectively required by the pixel circuits 1 to the source driving circuit 2, the source driving circuit 2 inputs the compensated data voltage signals to the data voltage terminals Data respectively coupled to the pixel circuits 1, so that the pixel driving circuit 100 in each pixel circuit 1 drives a corresponding self-luminescent device 10 to emit light according to a corresponding compensated data voltage signal.

Optionally, the controller 3 is a single chip microcomputer or a microcontroller unit (MCU).

In the compensation assembly 1000 provided by some embodiments of the present disclosure, after the photosensitive detection circuit 200 in the pixel circuit 1 is used to accurately detect the actual luminance of the corresponding self-luminescent device 10 in the same sub-pixel, data voltage compensation signals respectively corresponding to respective pixel circuits 1 may be generated by using the controller 3. Since the data voltage compensation signals are generated according to the difference between the actual luminance and the target luminance of the self-luminescent devices 10, which comprehensively considers various influencing factors that may cause a change of the luminance of the self-luminescent devices 10, a phenomenon of uneven luminance due to the aging of the self-luminescent device 10, the IR Drop and the like may be effectively improved, thereby improving the luminance compensation effect of the display panel.

Figure 10:
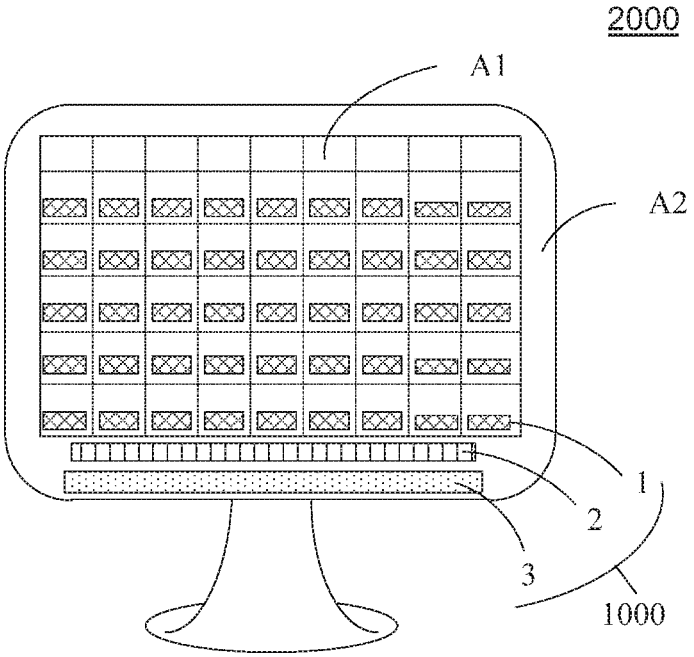
FIG. 10 is a schematic diagram showing a structure of a display apparatus, according to some embodiments of the present disclosure.

Some embodiments of the present disclosure provide a display apparatus. Referring to FIG. 10, the display apparatus 2000 includes the compensation assembly 1000 according to some embodiments described above. The display apparatus 2000 may be any product or component having a display function such as an OLED display, a digital photo frame, a mobile phone, a tablet computer or a navigator.

The display apparatus 2000 has a display area A1 and a non-display area A2 disposed around the display area. The controller 3 and the source driving circuit 2 in the compensation assembly 1000 are generally disposed in the non-display area A2. Each pixel circuit 1 in the compensation assembly 1000 is generally disposed in a corresponding sub-pixel region in the display area A1.

It will be added that the self-luminescent device 10 in each pixel circuit 1 is generally disposed in an open region of a corresponding sub-pixel region. The driving sub-circuit 11 and the readout circuit 21 are generally disposed in a region other than the open region in the sub-pixel region. The photosensitive diode D in the photosensitive device 20 is generally disposed in a region as proximate as possible to an edge of a corresponding open region, and is located at a light exit side of the self-luminescent device 10.

Beneficial effects that may be achieved by the display apparatus provided by some embodiments of the present disclosure are the same as beneficial effects that may be achieved by the compensation assembly in some embodiments described above, and details are not described herein again.

Figure 9:
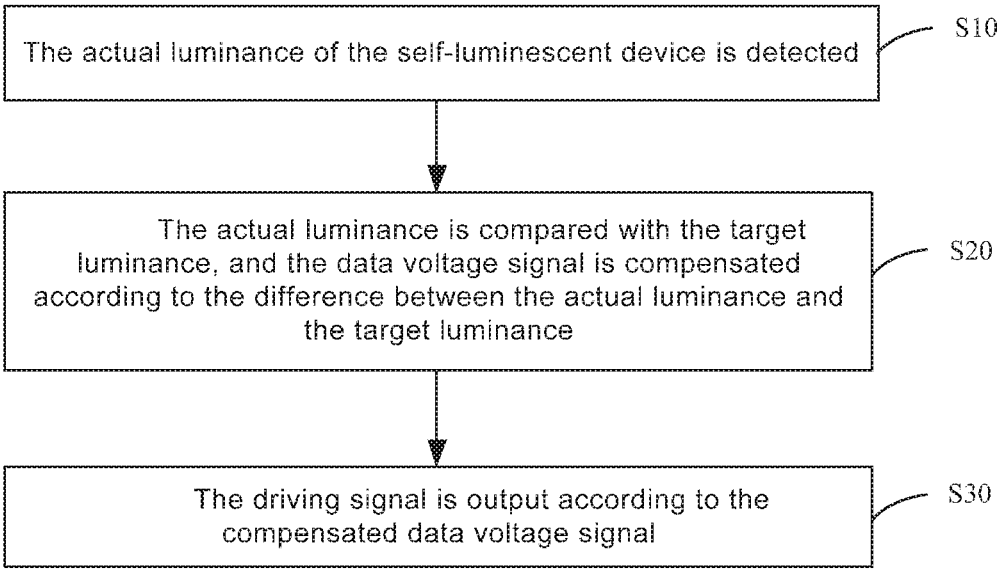
FIG. 9 is a flow diagram of a compensation method of a compensation assembly, according to some embodiments of the present disclosure.

Some embodiments of the present disclosure provide a compensation method. Referring to FIG. 9, the compensation method includes step 10 to step 30 (S10-S30).

In S10, the actual luminance of the self-luminescent device 10 is detected.

This step is completed by the pixel circuit 1 in the compensation assembly 1000 in some embodiments described above. The pixel circuit 1 transmits the electrical signal for characterizing the luminance of the self-luminescent device 10 in the corresponding sub-pixel to a control element, such as the controller 3 in the compensation assembly 1000. The control element identifies the electrical signal for characterizing the luminance of the self-luminescent device 10 to obtain the actual luminance of the self-luminescent device 10.

In S20, the above actual luminance is compared with the target luminance, and the data voltage signal is compensated according to the difference between the actual luminance and the target luminance.

The control element compares the obtained actual luminance of the self-luminescent device 10 with a pre-stored target luminance, and thus determines a luminance of the self-luminescent device 10 required to be compensated according to the difference between the actual luminance and the target luminance, thereby compensating the data voltage signal required to drive the self-luminescent device 10 to emit light.

In S30, the driving signal is output according to the compensated data voltage signal.

After the controller 3 in the compensation assembly 1000 transmits the compensated data voltage signal to the source driving circuit 2, the source driving circuit 2 may input the driving signal to the pixel driving circuit 100 in the pixel circuit 1 according to the compensated data voltage signal.

Beneficial effects that may be achieved by the compensation method provided by some embodiments of the present disclosure are the same as the beneficial effects that may be achieved by the compensation assembly in some embodiments described above, and details are not described herein.

Figure 11:
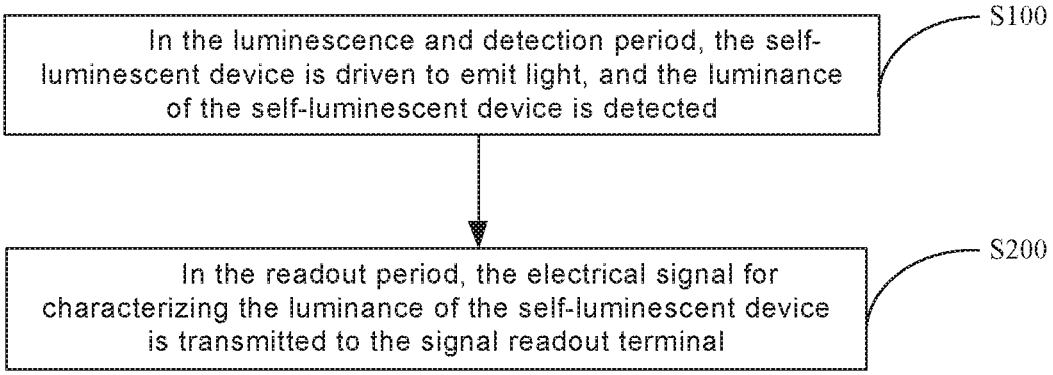
FIG. 11 is a flow diagram of a driving method of a display apparatus, according to some embodiments of the present disclosure.

Some embodiments of the present disclosure provide a driving method of the display apparatus. Referring to FIG. 11, the driving method includes step 100 to step 200 (S100-S200). The time of a frame includes the luminescence and detection period T1 and the readout period T2.

In S100, in the luminescence and detection period T1, the self-luminescent device 10 is driven to emit light, and the luminance of the self-luminescent device 10 is detected.

Figure 12:
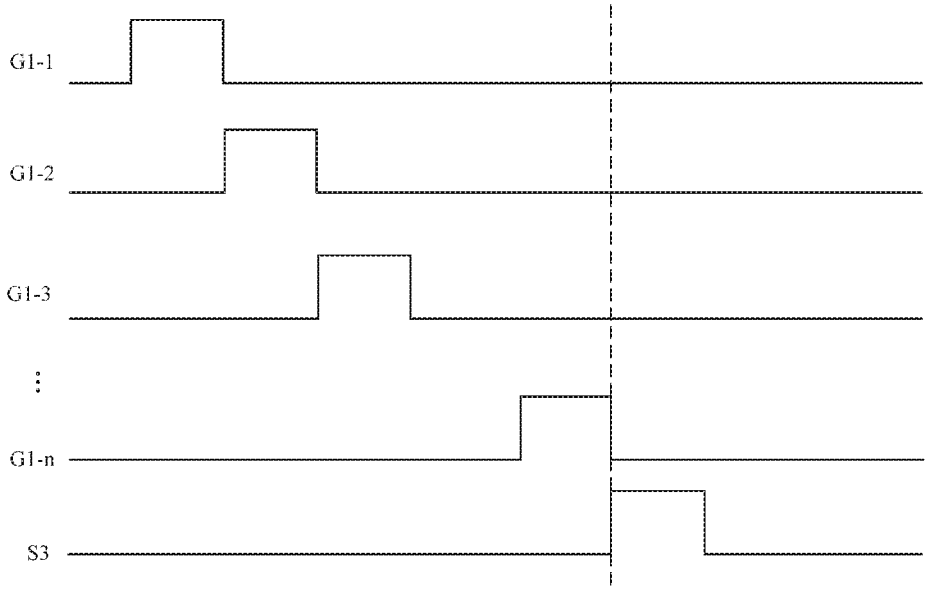
FIG. 12 is a timing diagram of controlling a display apparatus during a driving process, according to some embodiments of the present disclosure.

For example, the plurality of sub-pixels of the display apparatus are arranged in an array, and each sub-pixel is provided with the pixel circuit 1 provided by some embodiments described above therein. The scanning signal terminals G1 of respective pixel circuits 1 corresponding to each row of sub-pixels share a same gate line. Referring to FIG. 12, in a driving process of a display of a frame, respective gate lines (G1-1, G1-2, G1-3, . . . , and G1-*n*) are turned on row by row to control the self-luminescent devices 10 in the corresponding sub-pixels to emit light row by row. In each sub-pixel, the photosensitive detection circuit 200 in the pixel circuit detects the luminance of the self-luminescent device 10 when the self-luminescent device 10 emits light.

In S200, in the readout period T2, the electrical signal for characterizing the luminance of the self-luminescent device 10 is transmitted to the signal readout terminal Readout.

For example, with continued reference to FIGS. 5 and 12, after the respective gate lines (G1-1, G1-2, G1-3, . . . , and G1-*n*) are turned on row by row, the third control signal terminal S3 controls the fourth transistor T4 to be turned on, and respective readout circuits 21 of the pixel circuits 1 in the plurality of sub-pixels may simultaneously transmit luminance information of the corresponding self-luminescent devices 10 to the signal readout terminals Readout. Each signal readout terminal Readout is coupled to the controller 3 through a corresponding signal read line Readline, and a luminance signal of a corresponding self-luminescent device 10 received by the signal readout terminal Readout may be transmitted to the controller 3.

It will be noted that, firstly, in an entire process of displaying images by the display apparatus, the S10 and the S20 are executed when each frame is displayed. Alternatively, the S10 and the S20 are executed when a certain frame or several frames are displayed, and only the S10 is executed when other frames other than the certain frame or the several frames are displayed.

Secondly, the self-luminescent device 10 does not emit light in the readout period T2. Therefore, during a display process of the display apparatus, a time length of the readout period T2 is shortened as much as possible, and thus a refresh frequency of the display apparatus may be increased as much as possible to achieve a better display effect.

Optionally, in some embodiments of the present disclosure, in a case where the pixel circuit 1 has the structure shown in FIG. 5, driving the self-luminescent device 10 to emit light in the above S100, includes:

controlling the second transistor T2 to be turned on, transmitting, by the second transistor T2, the supply voltage signal from the second voltage terminal V2 to the control electrode of the third transistor T3, and controlling the third transistor T3 to be turned on;

transmitting, by the third transistor T3, the supply voltage signal from the second voltage terminal V2 to the first electrode of the driving transistor Td;

controlling the fifth transistor T5 and the sixth transistor T6 to be turned on, transmitting, by the fifth transistor T5, the data voltage signal from the data voltage terminal Data to the control electrode of the driving transistor Td and the first electrode of the storage capacitor Cst, and transmitting, by the sixth transistor T6, a potential signal of the signal readout terminal Readout to the second electrode of the driving transistor Td; and controlling the driving transistor Td to be turned on by using the data voltage signal, and outputting, by the driving transistor Td, the driving signal via the second electrode of the driving transistor Td to the self-luminescent device 10 to drive the self-luminescent device 10 to emit light.

In some embodiments of the present disclosure, with continued reference to FIG. 5, detecting the luminance of the self-luminescent device 10 in the above S100, includes:

controlling the first transistor T1 to be turned on before controlling the second transistor T2 to be turned on;

after controlling the second transistor T2 to be turned on, transmitting the supply voltage signal from the second voltage terminal V2 to the second electrode of the photosensitive diode D, so that the photosensitive diode D is reverse biased;

controlling the first transistor T1 to be turned off, and a voltage on the second electrode of the photosensitive diode D being changed under illumination of the self-luminescent device 10; and detecting the luminance of the self-luminescent device 10 according to a change of the voltage on the second electrode of the photosensitive diode D.

In some embodiments of the present disclosure, with continued reference to FIG. 5, transmitting the electrical signal for characterizing the luminance of the self-luminescent device 10 to the signal readout terminal Readout in the above S200, includes:

controlling the first transistor T2 to be turned on, and transmitting the voltage on the second electrode of the photosensitive diode D to the control electrode of the third transistor T3; and controlling the fourth transistor T4 to be turned on, and transmitting the voltage on the second electrode of the third transistor T3 to the signal readout terminal Readout. In this case, the driving transistor Td coupled to the second electrode of the third transistor T3 is used as the current source, and the voltage on the second electrode of the third transistor T3 follows the voltage on the control electrode of the third transistor T3 in phase.

Beneficial effects that may be achieved by the driving method of the display apparatus provided by some embodiments of the present disclosure are the same as the beneficial effects that may be achieved by the display apparatus in some embodiments described above, and details are not described herein again.

The foregoing descriptions are merely specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel circuit, comprising:

a driving sub-circuit coupled to a self-luminescent device, the driving sub-circuit being configured to drive the self-luminescent device to emit light in a luminescence and detection period in time of a frame, wherein the time of the frame includes the luminescence and detection period and a readout period; and a photosensitive detection circuit coupled to the driving sub-circuit, and configured to detect a luminance of the self-luminescent device in the luminescence and detection period, and transmit an electrical signal for characterizing the luminance of the self-luminescent device to a signal readout terminal in the readout period, wherein the photosensitive detection circuit includes a photosensitive device and a readout circuit;

the photosensitive device is configured to detect the luminance of the self-luminescent device;

the readout circuit is coupled to the photosensitive device and the signal readout terminal, and the readout circuit is configured to transmit the electrical signal for characterizing the luminance of the self-luminescent device to the signal readout terminal;

the photosensitive device includes a photosensitive diode, a first transistor and a second transistor, the photosensitive device is coupled to a first voltage terminal, a first control signal terminal, a second control signal terminal and an output terminal, and the photosensitive device is further coupled to a second voltage terminal or a supply voltage terminal;

the readout circuit includes a third transistor and a fourth transistor, the readout circuit is coupled to the output terminal of the photosensitive device the second voltage terminal, the driving sub-circuit, a third control signal terminal and the signal readout terminal; or, the readout circuit includes a third transistor, a fourth transistor and a current source, the readout circuit is coupled to the output terminal of the photosensitive device, the supply voltage terminal, the current source, the third control signal terminal and the signal readout terminal;

the driving sub-circuit includes a driving transistor, a fifth transistor, a sixth transistor, and a storage capacitor; and the driving sub-circuit is coupled to a data voltage terminal, a scanning signal terminal, the readout circuit, the self-luminescent device, and the signal readout terminal; or, the driving sub-circuit is coupled to a data voltage terminal, a scanning signal terminal, and the output terminal of the photosensitive device, the self-luminescent device and the signal readout terminal, wherein the pixel circuit being configured to drive the self-luminescent device to emit light includes:

the photosensitive device being configured to control the second transistor to be turned on, the second transistor transmitting a supply voltage signal from the second voltage terminal or the supply voltage terminal to a control electrode of the third transistor, and to control the third transistor to be turned on;

the third transistor transmitting the supply voltage signal from the second voltage terminal to a first electrode of the driving transistor, or the output terminal of the photosensitive device transmitting the supply voltage signal from the supply voltage terminal to a first electrode of the driving transistor;

the driving sub-circuit being further configured to control the fifth transistor and the sixth transistor to be turned on, the fifth transistor transmitting a data voltage signal from the data voltage terminal to a control electrode of the driving transistor and a first electrode of the storage capacitor, and the sixth transistor transmitting a potential signal of the signal readout terminal to a second electrode of the driving transistor; and the data voltage signal controlling the driving transistor to be turned on, and the driving transistor outputting a driving signal via the second electrode of the driving transistor to the self-luminescent device to drive the self-luminescent device to emit light.

2. The pixel circuit according to claim 1, wherein the photosensitive detection circuit and the driving sub-circuit are configured to share a same supply voltage terminal, and the photosensitive detection circuit is further configured to receive a supply voltage from the supply voltage terminal, and transmit the supply voltage to the driving sub-circuit.

3. The pixel circuit according to claim 2, wherein a first electrode of the photosensitive diode is coupled to the first voltage terminal, and a second electrode of the photosensitive diode is coupled to a first electrode of the first transistor;

a control electrode of the first transistor is coupled to the first control signal terminal, and a second electrode of the first transistor is coupled to the output terminal;

a control electrode of the second transistor is coupled to the second control signal terminal, a first electrode of the second transistor is coupled to the supply voltage terminal, and a second electrode of the second transistor is coupled to the output terminal; and the photosensitive diode is located in a position where the photosensitive diode is capable of detecting the light emitted from the self-luminescent device.

4. The pixel circuit according to claim 3, wherein a control electrode of the third transistor is coupled to the output terminal of the photosensitive device, a first electrode of the third transistor is coupled to the supply voltage terminal, and a second electrode of the third transistor is coupled to a first electrode of the fourth transistor and the current source; and a control electrode of the fourth transistor is coupled to the third control signal terminal, and a second electrode of the fourth transistor is coupled to the signal readout terminal.

5. The pixel circuit according to claim 4, wherein a control electrode of the fifth transistor is coupled to the scanning signal terminal, a first electrode of the fifth transistor is coupled to the data voltage terminal, and a second electrode of the fifth transistor is coupled to the control electrode of the driving transistor;

a first electrode of the driving transistor is coupled to the output terminal of the photosensitive device, and a second electrode of the driving transistor is coupled to the self-luminescent device;

a control electrode of the sixth transistor is coupled to the scanning signal terminal, a first electrode of the sixth transistor is coupled to the second electrode of the driving transistor, and a second electrode of the sixth transistor is coupled to the signal readout terminal;

the first electrode of the storage capacitor is coupled to the control electrode of the driving transistor and the second electrode of the fifth transistor, and a second electrode of the storage capacitor is coupled to the second electrode of the driving transistor and the first electrode of the self-luminescent device.

6. The pixel circuit according to claim 1, wherein a first electrode of the photosensitive diode is coupled to the first voltage terminal, and a second electrode of the photosensitive diode is coupled to a first electrode of the first transistor;

a control electrode of the first transistor is coupled to the first control signal terminal, and a second electrode of the first transistor is coupled to the output terminal;

a control electrode of the second transistor is coupled to the second control signal terminal, a first electrode of the second transistor is coupled to the second voltage terminal, and a second electrode of the second transistor is coupled to the output terminal; and the photosensitive diode is located in a position where the photosensitive diode is capable of detecting the light emitted from the self-luminescent device.

7. The pixel circuit according to claim 6, wherein a control electrode of the third transistor is coupled to the output terminal of the photosensitive device, a first electrode of the third transistor is coupled to the second voltage terminal, and a second electrode of the third transistor is coupled to a first electrode of the fourth transistor and the driving sub-circuit; and a control electrode of the fourth transistor is coupled to the third control signal terminal, and a second electrode of the fourth transistor is coupled to the signal readout terminal.

8. The pixel circuit according to claim 7, wherein the control electrode of the driving transistor is coupled to the data voltage terminal, a first electrode of the driving transistor is coupled to the second electrode of the third transistor, and a second electrode of the driving transistor is coupled to the self-luminescent device.

9. The pixel circuit according to claim 8, wherein the control electrode of the driving transistor is coupled to the data voltage terminal through the fifth transistor, wherein a first electrode of the fifth transistor is coupled to the data voltage terminal, a second electrode of the fifth transistor is coupled to the control electrode of the driving transistor, and a control electrode of the fifth transistor is coupled to the scanning signal terminal;

the first electrode of the storage capacitor is coupled to the control electrode of the driving transistor and the second electrode of the fifth transistor, and a second electrode of the storage capacitor is coupled to the second electrode of the driving transistor and the self-luminescent device; and a control electrode of the sixth transistor is coupled to the scanning signal terminal, a first electrode of the sixth transistor is coupled to the second electrode of the driving transistor, and a second electrode of the sixth transistor is coupled to the signal readout terminal.

10. A compensation assembly, comprising:

at least one pixel circuit according to claim 1;

a source driving circuit; and a controller coupled to both the at least one pixel circuit and the source driving circuit, wherein the controller is configured to obtain an actual luminance of at least one self-luminescent device according to at least one electrical signal output by the at least one pixel circuit for characterizing luminance of the at least one self-luminescent device, and compensate a data voltage signal according to a difference between an actual luminance and a target luminance of each self-luminescent device; and the source driving circuit is configured to output a driving signal to a corresponding one of the at least one pixel circuit based on the compensated data voltage signal.

11. A display apparatus, comprising the compensation assembly according to claim 10.

12. A method of driving the display apparatus according to claim 11, comprising:

driving each self-luminescent device to emit light and detecting the luminance of the self-luminescent device in the luminescence and detection period; and transmitting the electrical signal for characterizing the luminance of the self-luminescent device to the signal readout terminal in the readout period, wherein driving the self-luminescent device to emit light includes:

controlling the second transistor to be turned on, transmitting, by the second transistor, the supply voltage signal from the second voltage terminal or the supply voltage terminal to the control electrode of the third transistor, and controlling the third transistor to be turned on;

transmitting, by the third transistor, the supply voltage signal from the second voltage terminal to the first electrode of the driving transistor, or transmitting, by the output terminal of the photosensitive device, the supply voltage signal from the supply voltage terminal to the first electrode of the driving transistor;

controlling the fifth transistor and the sixth transistor to be turned on, transmitting, by the fifth transistor, the data voltage signal from the data voltage terminal to the control electrode of the driving transistor and the first electrode of the storage capacitor, and transmitting, by the sixth transistor, the potential signal of the signal readout terminal to the second electrode of the driving transistor; and controlling, by the data voltage signal, the driving transistor to be turned on, and outputting, by the driving transistor, the driving signal via the second electrode of the driving transistor to the self-luminescent device to drive the self-luminescent device to emit light.

13. The driving method according to claim 12, wherein detecting a luminance of the self-luminescent device in the luminescence and detection period, includes:

controlling the first transistor to be turned on before controlling the second transistor to be turned on;

after controlling the second transistor to be turned on, transmitting the supply voltage signal from the second voltage terminal to a second electrode of the photosensitive diode, so that the photosensitive diode is reverse biased;

controlling the first transistor to be turned off, a voltage on the second electrode of the photosensitive diode being changed under illumination of the self-luminescent device; and detecting the luminance of the self-luminescent device according to a change of the voltage on the second electrode of the photosensitive diode.

14. The driving method according to claim 13, wherein transmitting the electrical signal for characterizing the luminance of the self-luminescent device to the signal readout terminal, includes:

controlling the first transistor to be turned on, and transmitting the voltage on the second electrode of the photosensitive diode to the control electrode of the third transistor; and controlling the fourth transistor to be turned on, transmitting a voltage on a second electrode of the third transistor to the signal readout terminal, the voltage on the second electrode of the third transistor following a voltage on the control electrode of the third transistor in phase.

15. A compensation method of the compensation assembly according to claim 10, comprising:

detecting an actual luminance of each self-luminescent device;

comparing the actual luminance and a target luminance, and compensating a data voltage signal according to a difference between the actual luminance and the target luminance; and outputting a driving signal according to the compensated data voltage signal.

16. The pixel circuit according to claim 1, further comprising the self-luminescent device.

* * * * *